US005549072A

United States Patent [19]

Maloney

[11] Patent Number: 5,549,072

[45] Date of Patent: Aug. 27, 1996

[54] BOAT SEAT STAND

[75] Inventor: Peter E. Maloney, Louisville, Ky.

[73] Assignee: Concept Outdoor Advertising, Inc., Louisville, Ky.

[21] Appl. No.: 370,796

[22] Filed: Jan. 10, 1995

[51] Int. Cl.[6] ..... B63B 17/00

[52] U.S. Cl. ..... 114/363; 248/188.002

[58] Field of Search ..... 297/130, 344.18, 297/452.20; 248/165, 164, 188.7; 114/363, 343, 270, 221 R, 188, 194

[56] References Cited

U.S. PATENT DOCUMENTS

| | | | |
|---|---|---|---|
| 1,365,873 | 1/1921 | Waderlow | 248/165 |
| 2,218,583 | 10/1940 | Marthaler | 29/897 |
| 3,141,557 | 7/1964 | Marchak | 211/205 |
| 3,223,368 | 12/1965 | Pollack | 248/158 |
| 3,244,128 | 4/1966 | Rogalski et al. | 108/153 |
| 3,553,871 | 1/1971 | Benchley, Jr. | 248/165 |
| 4,828,208 | 5/1989 | Peterson et al. | 248/188.2 |
| 5,197,406 | 3/1993 | Rabal et al. | 114/363 |

FOREIGN PATENT DOCUMENTS

| | | | |
|---|---|---|---|
| 363125 | 12/1931 | United Kingdom | 248/165 |

*Primary Examiner*—Edwin L. Swinehart

*Attorney, Agent, or Firm*—Middleton & Reutlinger; James C. Eaves, Jr.

[57] ABSTRACT

A boat seat stand having a vertical member for receiving the downward extending post from a boat seat or a boat seat pedestal extension. Extending from the vertical member are a plurality of legs which engage the ground to support the stand and the boat seat. The legs are individual and removable for compact storage. In the preferred embodiment the legs nest into the vertical member to help prevent component loss, to make the storage configuration more compact, and to keep the components from banging around in the boat. The stand is particularly useful when one wants to sit near a moored boat, as one does not have to carry a separate chair for shore use. One simply sets up the boat seat stand and uses it with the removable boat seat.

17 Claims, 4 Drawing Sheets

BOAT SEAT STAND

BACKGROUND OF THE INVENTION (a) Field of the Invention

The present invention relates to a boat seat stand. The preferred stand can be compactly stored on a boat and then easily assembled for use with a removable boat seat, for example, on the shore.

(b) Description of the Prior Art

U.S. Pat. No. 4,828,208, to Peterson, teaches a vertically adjustable table with retractable caster assembly. Base 3 includes four generally L-shaped tubular legs attached to the side faces 16–19 of center column 15.

U.S. Pat. No. 3,244,128, to Rogalski, teaches a supporting stand 10. Stand 10 has a center post 11 having a short tubular metal sleeve 15 at its lower end. Post 11, being inserted into sleeve 15, forms a limiting shoulder 16. Four supporting legs 14, formed of square tubular stock, each have an angular bend therein such that each leg 14 has a short vertical portion 33 and a relatively long angular portion 34. Legs 14 have their vertical portions abutting and received within sleeve so that the leg 14 uppermost ends 36 contact limiting shoulder 16. A screw 38 is threadably received at the intersection of the four legs 14 to prevent them from falling out of sleeve 15. The stand 10 is not designed to swivel. Further, legs 14 are "bent" on the leg diagonal rather that the leg side so that the stand has two "forward-facing" legs and two "rearward-facing" legs. This bend, along with limiting shoulder 16 do not permit leg "nesting" for stand storage.

U.S. Pat. No. 3,223,368, to Pollock, teaches a furniture pedestal having four star feet 17'. Feet 17' are formed from quadrant pieces 17∝*a*, 17'*b*, 17'*c*, and 17'*d*, having inner arcuate surfaces, so that when they are joined and secured by a collar 30', a central cylindrical opening 40 remains for receipt of the lower end of a swivel element 41. Swivel element 41 passes downward through stanchion pipe 15. The quadrant pieces 17'*a*, 17'*b*, 17'*c*, and 17'*d* are held together by cross staples 31.

U.S. Pat. No. 3,141,557, to Marschak, teaches a support for a stand and the like. Leg units A and B are each formed by welding two bent rods together along their vertical sections (10 & 12 and 20 & 22). The abutting vertical portions of leg units A and B (14 & 16 and B's unnumbered portions) are inserted upwardly into square-shaped coupling sleeve 24 to provide a relatively close fit therein. Upward insertion is limited by the inclined portion of leg units A a B (numbered 15 & 17 for unit A).

U.S. Pat. No. 2,218,583, to Marthaler, teaches a chair base having legs 6 having their upper vertical ends placed into the four corners of a cap 7 and a spreader block 9 forcibly inserted therebetween and welded. Cylindrical opening 10 through cap 7 and block 9 is to receive a chair swivel. The alternative embodiment of FIGS. 4 and 5 incorporates a swivel bearing 15 central to spreader block 14.

SUMMARY OF THE INVENTION

The present invention is for a boat seat stand. Most fishing boats have removable seats. Typical boat seats, for example, have a downward extending steel post member of four to six inches in length which is insertably received into a permanent pedestal bushing on the boat. A coiled spring is usually received over the post member. To raise the seat to a higher height, some boat seats provide a pedestal extension member which is insertably received into the pedestal bushing on the boat. Then, the boat seat post member is inserted into the pedestal extension member.

Boat operators or passengers often wish to pull ashore and sit down in close proximity to the boat, for example, at a campsite on an overnight fishing trip. Space on a boat is very limited and so the present invention eliminates the need to carry a separate seat or chair for use at the camp. The compactly stowable boat seat stand of the instant invention can be removed from a storage bag or container and easily assembled. Then, the boat seat can be removed from the boat and inserted into the assembled stand on shore.

More particularly, the boat seat stand of the present invention comprises a plurality of leg members, for example, three of four legs, and a vertical base member having both means for receiving a boat seat vertical member or a boat seat pedestal extension member and integral or external means for receiving the plurality of leg members. Depending upon the orientation of the leg receiving means, the legs are straight or bent. In the preferred embodiment, the leg outward extending portions are nestably receivable into the leg receiving means for compact storage and the leg vertical portions are supportably receivable into the leg receiving means for use.

Finally, the present invention comprises a boat seat stand including a plurality of bent leg members, each bent leg member having a vertical portion and a outward extending portion; a vertical base member having a top and a bottom, the vertical base member having means for receiving a downwardly extending vertical member at the top, the vertical base member having means for receiving the plurality of leg members; whereby the leg receiving means receives the vertical portions of the plurality of leg members to place the boat seat stand in an operable configuration for supporting a boat seat and whereby the leg receiving means receives the outward extending portions of the plurality of leg members to place the boat seat stand in a storage configuration.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 3:
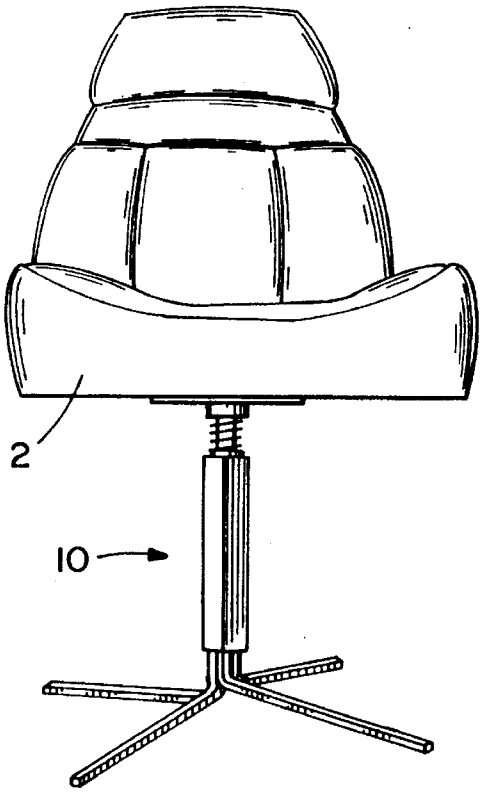
FIG. 3 shows a perspective view of the boat seat inserted into the boat seat stand of the preferred embodiment.

The present invention relates to a boat seat stand. The boat seat stand 10 of the preferred embodiment is shown in FIGS. 1–6. Stand 10 is designed to support a removable boat seat 2. Seat 2 has a bottom 4 having a vertical member 6 extending downwardly therefrom. For a typical seat 2, member 6 has, for example, a length of four to six inches and a diameter of ¾ inch. Member 6 is shown having a coiled spring 8 thereover. On a boat, seat 2's member 6 with spring 8 thereover are received into a boat seat pedestal bushing (not shown). As is seen in a later figure, some boat seat pedestals and boat seats have a pedestal extension 9 inserted therebetween to raise the height of the boat seat in the boat.

Stand 10 includes a vertical base member 12 and four bent legs 20. A stand storage bag (not shown) may be included to help ensure that the five metal parts do not damage the boat during storage. For example, base member 12, a square tube, has a one inch internal side dimension and a length of about nine inches.

Legs 20, for example, are square and have an outer side dimension of ½ inch. Thus, the four legs 20, when placed in an abutting relationship form a one inch square. Member 12 has a lower square opening 14 for securely receiving the four legs 20.

Member 12 has an upper opening 16 which receives a bushing 18 therein. Bushing 18 is shown having a circular opening thereinto; however, a square or triangular shaped opening would still support a circular member 6 inserted thereinto. Bushing 18 can include a lip 19 which prevents bushing 18 from being forced too far into member 12. For example, bushing 18 can be sized so that it is securely press fitted into upper opening 14. Bushing 18 is similar to the pedestal bushing on the boat. For example, bushing 18 has an inside circular opening diameter of ¾ inch for receiving the ¾ inch diameter seat member 6.

Figure 6:
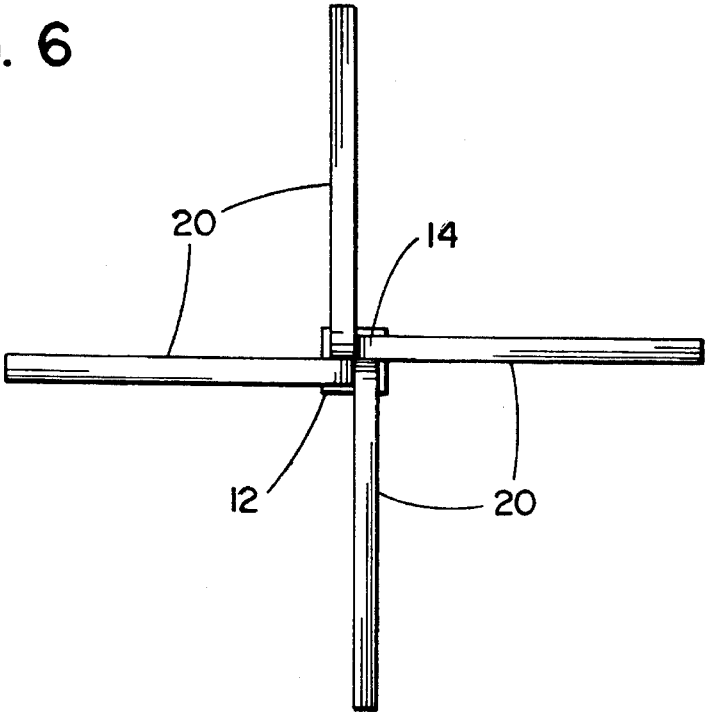
FIG. 6 shows a bottom view of the preferred boat seat stand, to demonstrate how the four legs are received into the stand base.
Figure 4:
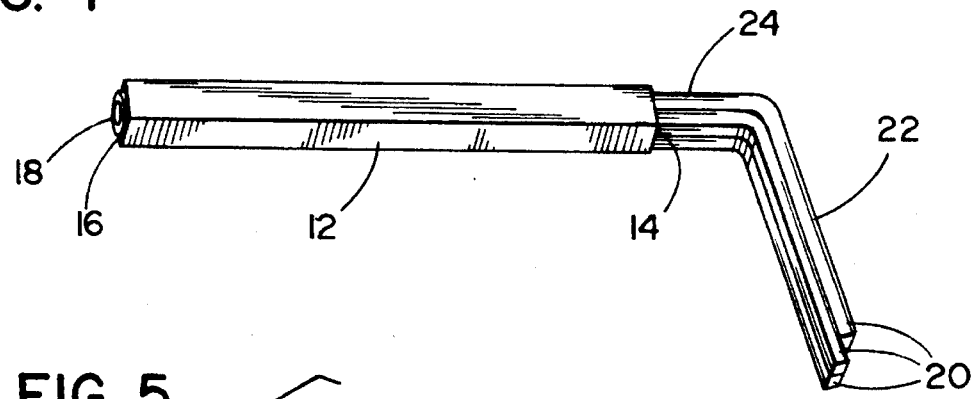
FIG. 4 shows a perspective view of the boat seat stand of FIG. 1, the stand being in the storable configuration.
Figure 5:
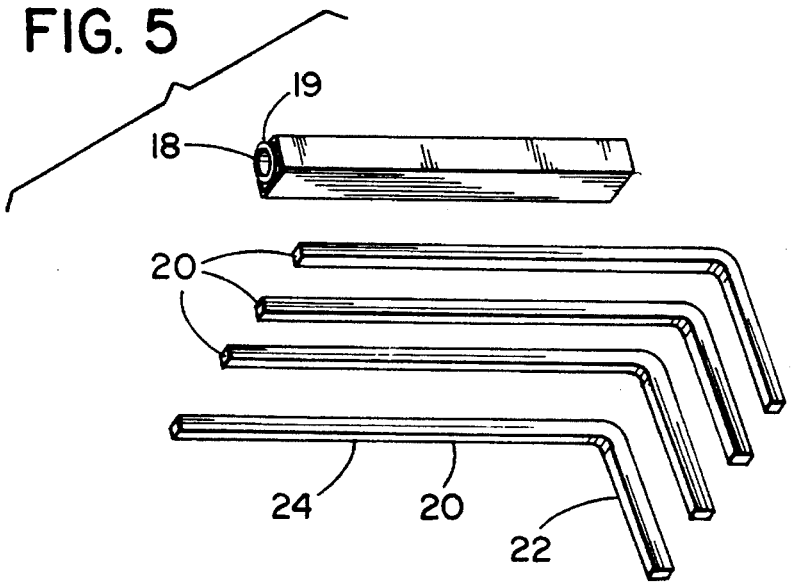
FIG. 5 shows the five components of the boat seat stand of the preferred embodiment, the four legs having been removed from the storage position of FIG. 4 and ready for assembly.

Legs 20 are bent and have a vertical portion 22 insertable into opening 14 when the stand 10 is placed into it's operable configuration, as best seen in FIG. 6. Legs 20 have an outward extending portion 24 which engage the stand supporting surface when the stand 10 is placed into it's operable configuration and which are insertable into opening 14 when the stand 10 is placed into it's storage configuration, as best seen in FIG. 4. So that leg portions 24 correctly sit on the ground, the angle between portion 22 and portion 24 of each leg 20 should be identical and the angle should be ninety degrees or more. As shown in FIGS. 1–6, the angle between portions 22 and 24 is about 115 degrees.

Portion 22 should have a length long enough so that member 12 is vertically supported, but short enough so that seat member 6, when inserted into bushing 18 does not touch the ends of portions 22 inside member 12. For example, portion 22 could have a length of about four inches. Portion 24 should have a length long enough so that when stand 10 is in the operable configuration, for example, as seen in FIG. 3, the legs 20 will fully support the seat 2. For example, the portion 24 could have a length of about ten inches. For storage, portions 22 and 24 should be as short as possible, still considering the above mentioned operational length requirements.

Figure 1:
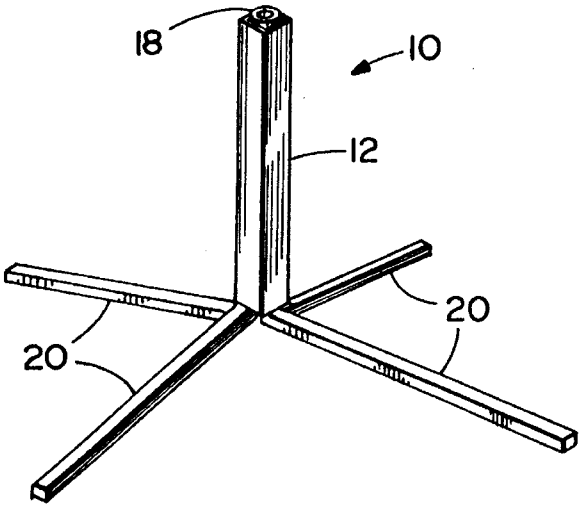
FIG. 1 shows a perspective view of an assembled boat seat stand of the preferred embodiment.
Figure 2:
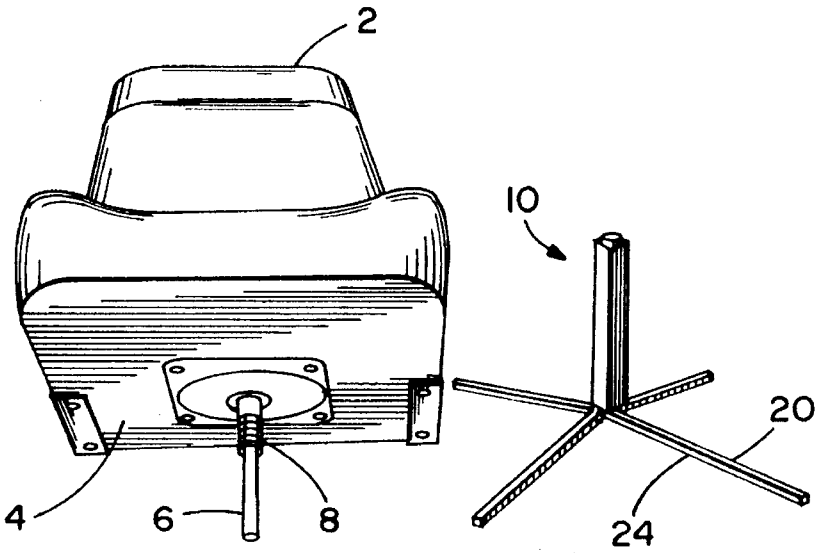
FIG. 2 shows a perspective view of the assembled boat seat stand of FIG. 1 and of a boat seat for insertion into the stand.

Because the stand 10 is easily set up and does not require any screws, bolts, pins, etc., a user should be able to go from the storage position of FIG. 4 to the operable position of FIG. 1 is about a minute. The user first removes legs portions 24 from opening 14 of member 12. Then, with member 12 upside down, the user can simply place leg portions 22 into opening 14 and turn the stand 10 over and place it on the ground for inserting the boat seat member 6 into bushing 18. Therefore, stand 10 of this preferred embodiment of FIGS. 1–6 is easy and quick to use and is compactly storable. By having the legs 20 nest inside the member 12 for storage, the likelihood of losing a component should be lessened and there are not loose pieces to bang around in the boat.

Figure 7:
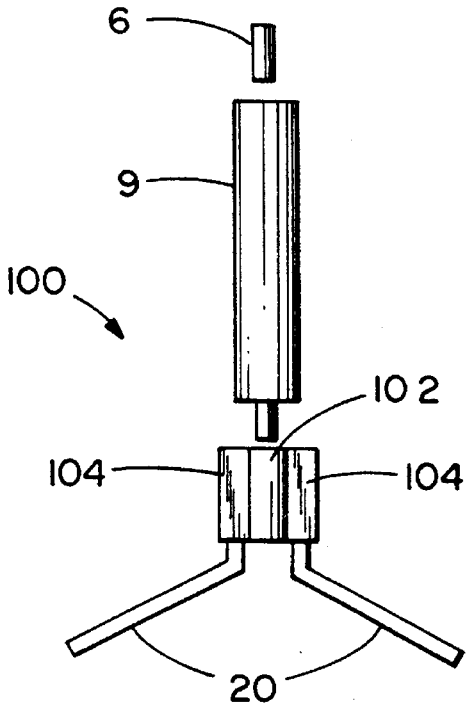
FIG. 7 shows a side view of a first alternative embodiment boat seat stand, the stand of a height designed to receive a boat seat pedestal extension and a boat seat.
Figure 8:
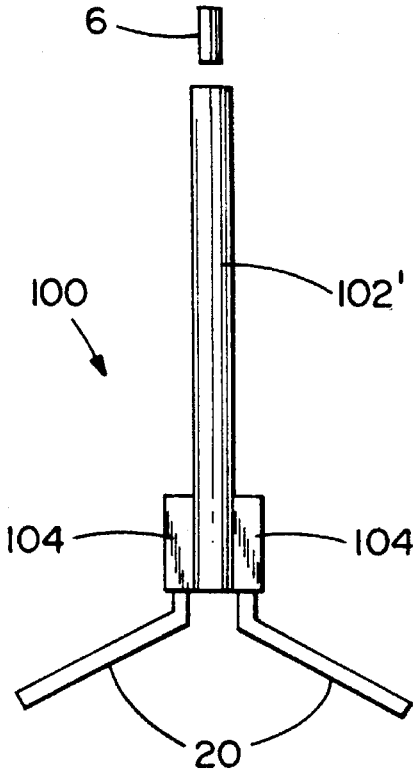
FIG. 8 shows a side view of a stand similar to the stand of FIG. 7, the stand having a taller stand base, the stand designed to directly receive the boat seat without the pedestal extension.
Figure 9:
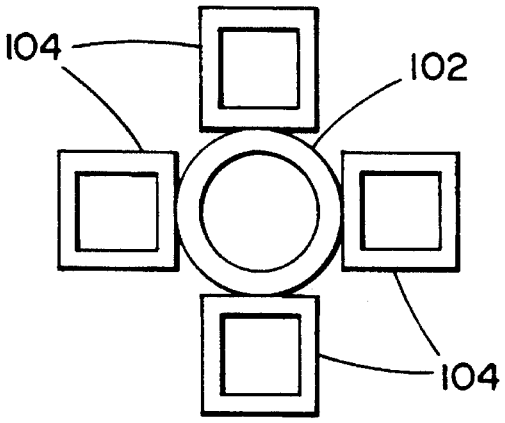
FIG. 9 shows a top view of the stand of FIG. 7.

FIGS. 7–9 show a first alternative embodiment stand 100 which uses the same or similar bent legs 20 of stand 10. With stand 100 a bushing, like bushing 18 of stand 10, is not required, as square tube 12 has been replaced with, for example, a ¾ inch diameter three inch long round tube vertical base member 102 (FIG. 7) or a ¾ inch diameter eight inch long round tube vertical base member 102' (FIG. 8). The "shorter" stand 100 of FIG. 7 is designed to be used with a seat 2 pedestal extension 9, which the "taller" stand 100 of FIG. 8 is designed to interface directly with a seat 2.

Figure 10:
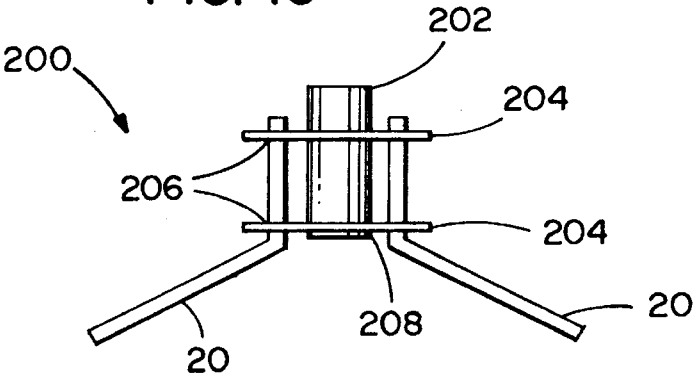
FIG. 10 shows a side view of a second alternative embodiment boat seat stand.

A plurality of square tubes 104 are attached to the outside of vertical base member 102/102'. If legs 20 are employed, square tubes 104 will have, for example, an internal side dimension of ½ inch, so that vertical portion 22 of each leg 20 fits snugly into respective tube 104. While FIG. 9 shows the use of four legs 20, with the individual tubes 104, only three tubes 104 would be required to support a seat 2. As seen in FIG. 10, the openings in member 102 and tubes 104 have parallel axes.

While portions 24 of legs can be inserted into tubes 104 for storage, because the legs 20 are spaced apart from each other instead of nesting as with stand 10, stand 100 does not store as compactly as stand 10. It is also noted that legs 20 and tubes 104 could have circular cross-sections instead of square cross-sections. However, the square cross-section maintains the legs 20 in a desired spaced apart relationship. With a circular cross-section the legs 20 could turn, making the stand unstable, so, for example, means for securing the legs could be employed. For example, a screw could be threadly received by a bore in each tube 104 to engage the respective leg 20 and secure the leg 20 therein.

FIG. 10 shows a second alternative embodiment stand 200 which uses the same or similar bent legs 20 of stands 10 and 100. Again, as with stand 100, stand 200 does not require a bushing 18 of stand 10, as square tube 12 has again been replaced with, for example, a ¾ inch diameter three inch long round tube vertical base member 202. As shown, member 202 is about three inches in length, for use with a pedestal extension 9 and a seat 2. As with the embodiments of FIGS. 7/8, member 202 could be, for example, eight inches long to interface directly with a seat 2.

It was previously mentioned that portion 22 of legs 20 could, for example, have a length of about four inches. A pair of horizontal plates 204 having a central bore 208 therethrough are secured transversely to vertical base member 202. Plates 204 are spaced apart about three inches and parallel to each other, for example. Plates 204 have a plurality of vertically aligned bores 206 therethrough. If three legs 20 are used, each plate 204 will have three bores 206. If four legs 20 are used, each plate 204 will have four bores 206. As with stand 100, the bores 206 and legs 20 can be of circular cross-section, with the same disadvantage as with stand 100, unless leg securing means are employed.

While portions 24 of legs can be inserted into respective bores 206 for storage, because the legs 20 are spaced apart from each other instead of nesting as with stand 10, stand 200 does not store as compactly as stand 10. However, if square member 12 and bushing 18 of stand 10 were used instead of circular member 202, the legs 20 of stand 200 would nest.

Figure 11:
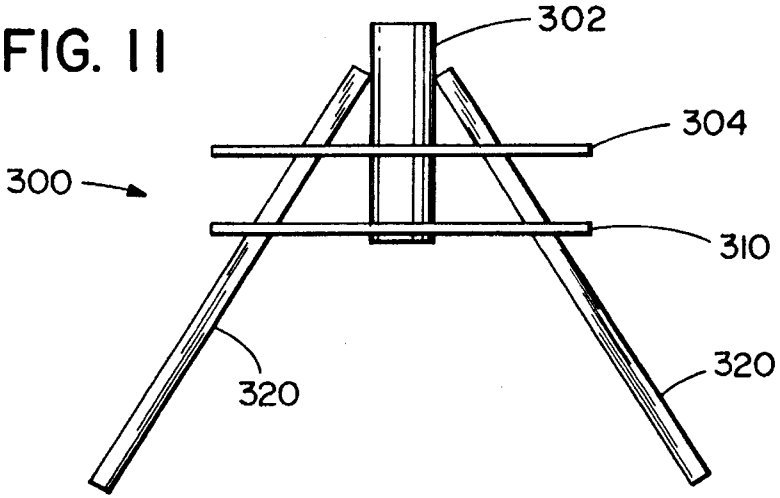
FIG. 11 shows a side view of a third alternative embodiment boat seat stand.
Figure 12:
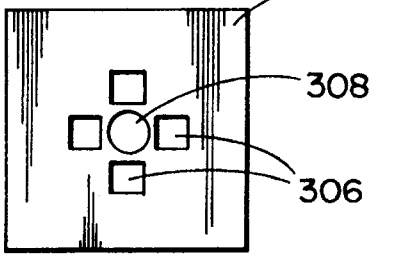
FIG. 12 shows a top view of the top horizontal plate of the stand of FIG. 11.
Figure 13:
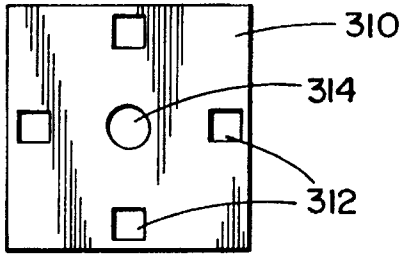
FIG. 13 shows a top view of the bottom horizontal plate of the stand of FIG. 11; and, FIG. 14 shows a side view of a portion of a fourth alternative embodiment boat seat stand.

FIGS. 11–13 show a third alternative embodiment stand 300 which is similar to stand 200, but which, by changing the alignment of the leg receiving bores in the parallel horizontal plates from vertical to slanted, permits straight legs to be used. Stand 300 does not require a bushing 18 of stand 10, as square tube 12 has again been replaced with, for example, a ¾ inch diameter three inch long round tube vertical base member 302. As shown, member 302 is about three inches in length, for use with a pedestal extension 9 and a seat 2, but, as with the embodiments of FIGS. 7/8, member 302 could be, for example, eight inches long to interface directly with a seat 2.

As with parallel horizontal plates 204 of stand 200, stand 300 employs a top horizontal plate 304 having a central bore 308 therethrough and a bottom horizontal plate 310 having a central bore 314 therethrough. Member 302 is placed through bores 308/314 in respective plates 304/310 and member 302 is secured to plates 304/310, for example, by welding, so that plates 304 and 310 are parallel to each other with a desired spacing therebetween, for example, three inches apart. Plates 304/310 are transverse to member 302.

Top plate 304 has a plurality of bores 306 therethrough. The bores 306 will have the shape of the legs 320 to be received therein and there will be one bore 306 for each leg 320. For example, typically three or four legs 320 would be employed. As shown with the plate 304 of FIG. 12, stand 300 will employ four square shaped straight legs 320. Preferably, bores 306 will be equally spaced on radials extending outward from central bore 308. Further, each bore 306 should be the same first preselected distance from central bore 308.

Bottom plate 310 has a plurality of bores 312 therethrough. As with bores 306, the bores 312 will have the shape of the legs 320 to be received therein and there will be one bore 312 for each leg 320. As shown with the plate 310 of FIG. 13, stand 300 will employ four square shaped straight legs 320. Preferably, bores 312 will be equally spaced on radials extending outward from central bore 314. Further, each bore 312 should be the same second preselected distance from central bore 314. The second preselected distance will be greater than the first preselected distance, so that a leg 320 inserted through a bore 312 and a cooperating bore 306 will engage the exterior of base member 302 at a desired angle. Assuming that the first preselected distance is fixed, increasing the second preselected distance will increase the angle between a leg 320 and member 302, thereby making the leg 320 less angled with respect to the ground. With straight legs 320, cooperating bores 306/312 fix the legs 320 with respect to each other. Therefore, for stand 300 as shown, legs 320 with either circular or square cross-section would function equally well.

Alternatively, legs 320 could be bent somewhat toward their outer ends and/or have foot pads inserted thereon. This would be particularly useful if the stand 300 was to be used on "soft" ground, as the bend or pads would provide more ground-engaging surface and the legs 320 would not be "pointed" to "puncture" the ground.

Figure 14:
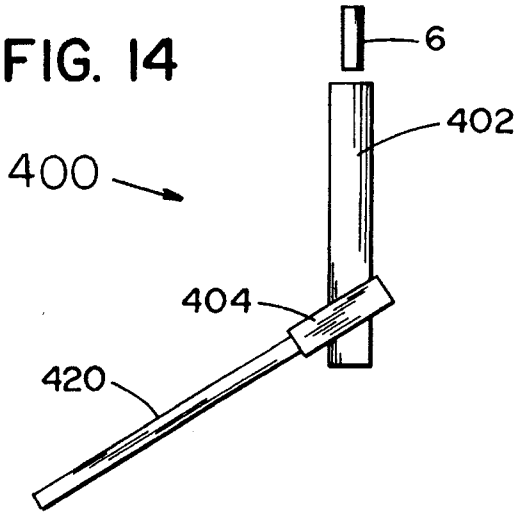

FIG. 14 shows a fourth alternative embodiment stand 400 which employs a plurality of straight legs 420, preferably three or four legs. Stand 400 does not require a bushing 18 of stand 10, as square tube 12 has again been replaced with, for example, a ¾ inch diameter three inch long round tube vertical base member 402. As shown, member 402 is about three inches in length, for use with a pedestal extension 9 and a seat 2, but, as with the embodiments of FIGS. 7/8, member 402 could be, for example, eight inches long to interface directly with a seat 2.

Stand 100 of FIGS. 7–9 employed vertical base member 102 and a plurality of square tubes 104, such that member 102 and tubes 104 were all vertically aligned. Because of this alignment, bent legs 20 were employed. With stand 400, so that straight legs 420 can be employed, a plurality of capped leg receiving members are secured around member 402 at an angle off of horizontal. There will be one member 404 for each leg 420 and, preferably, the members 404 will be equally spaced about member 402. As shown, member 404 is angled toward the ground at about fifteen degrees off horizontal. As with stand 300, the components of stand 400 can be compactly stored, but cannot be nested.

If a bushing similar to bushing 18 of stand 10 is employed with any of the above stands 100, 200, 300, 400, respective member 102 or 102', 202, 302,402 can be sufficiently sized and be of proper cross-section shape so that respective legs 20, 20, 320, 420 will nest therein for storage.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A boat seat stand, comprising:

a. a plurality of bent leg members, each bent leg member having a vertical portion and a outward extending portion; and, b. a vertical base member having a top and a bottom, said vertical base member having means for receiving a downwardly extending vertical member at said top, said vertical base member having means for receiving said vertical portions of said plurality of leg members to place said boat seat stand in an operable configuration for supporting a boat seat and for receiving said outward extending portions of said plurality of leg members to place said boat seat stand in a storage configuration.

2. The boat seat stand of claim 1, wherein, with said vertical portions of said plurality of leg members received by said vertical base member means for receiving said vertical portions of said plurality of leg members to place said boat seat stand in an operable configuration for supporting a boat seat and for receiving said outward extending portions of said plurality of leg members to place said boat seat stand in a storage configuration and with said means for receiving a downwardly extending vertical member receiving a member therein, said member received therein does not engage said vertical portions of said plurality of leg members.

3. The boat seat stand of claim 1, where said vertical base member has a square cross-section with a side having a first preselected dimension, where each of said plurality of leg members has a square cross-section with a side having a second preselected dimension, said second preselected dimension being approximately one-half said first preselected dimension, and where said plurality of bent leg members comprises four legs.

4. The boat seat stand of claim 3, where said first preselected dimension is approximately one inch and where said second preselected dimension is approximately one-half inch.

5. The boat seat stand of claim 1, where said vertical portion of each leg member has a length of approximately four inches, where said outward extending portion of each leg member has a length of approximately ten inches, where said vertical base member has a length of approximately nine inches.

6. The boat seat stand of claim 1, whereby, for each leg member, said vertical portion and said outward extending portion have a preselected angle therebetween, said preselected angle being at least ninety degrees.

7. The boat seat stand of claim 6, where preselected angle is about 115 degrees.

8. The boat seat stand of claim 1, where said vertical base top has an opening thereinto, where said means for receiving a downwardly extending vertical member comprises a bushing, said bushing having an opening thereinto for receiving said downwardly extending vertical member, said bushing being at least partways received into said opening thereinto said vertical base top.

9. The boat seat stand of claim 8, where said circular opening of said bushing has a circular cross-section and a diameter of three-fourth inch.

10. The boat seat stand of claim 8, whereby said bushing includes means for permitting swivelling.

11. The boat seat stand of claim 1, where said vertical base bottom has an opening thereinto, said opening being said means for receiving said vertical portions of said plurality of leg members to place said boat seat stand in an operable configuration for supporting a boat seat and for receiving said outward extending portions of said plurality of leg members to place said boat seat stand in a storage configuration.

12. The boat seat stand of claim 1, where said vertical base member has a plurality of vertical tubes attached thereto, said vertical base member and said plurality of vertical tubes having a parallel alignment, said plurality of vertical tubes being said means for receiving said vertical portions of said plurality of leg members to place said boat seat stand in an operable configuration for supporting a boat seat and for receiving said outward extending portions of said plurality of leg members to place said boat seat stand in a storage configuration.

13. The boat seat stand of claim 1, where said means for receiving said vertical portions of said plurality of leg members to place said boat seat stand in an operable configuration for supporting a boat seat and for receiving said outward extending portions of said plurality of leg members to place said boat seat stand in a storage configuration comprises a pair of plates, at least one of said plates having a central bore therethrough for receiving said vertical member, said plates being connected to said vertical member so that said plates are in a parallel separated relationship, said plates being transverse to said vertical member, said plates having a plurality of leg receiving bores therethrough, the plurality of leg receiving bores on one of said plates being vertically aligned with the plurality of leg receiving bores on the other of said plates.

14. The boat seat stand of claim 13, where said plates have a center point and where said plurality of leg receiving bores are spaced a preselected distance from said center point, said plurality of leg receiving bores having an equal angular spacing therebetween.

15. The boat seat stand of claim 12, where said vertical base member has a circular cross-section with a diameter having a first preselected dimension.

16. The boat seat stand of claim 13, where said vertical base member has a circular cross-section with a diameter having a first preselected dimension.

17. A boat seat stand, comprising:

a. four bent leg members, each of said bent leg members having a vertical portion and a outward extending portion, where each of said bent leg members having a square cross-section with a side having a first preselected dimension, where, for each of said bent leg members, said vertical portion and said outward extending portion have a preselected angle therebetween, said preselected angle being at least ninety degrees;

b. a bushing having a circular opening thereinto for receiving a downwardly extending vertical member; and, c. a hollow vertical base member having a top opening and a bottom opening, said bushing being at least partways received into said top opening, where said vertical base member has a square cross-section with a side having a second preselected dimension, said leg first preselected dimension being approximately one-half said vertical base member second preselected dimension, said vertical portions of said four bent leg members received by said bottom opening to place said boat seat stand in an operable configuration for supporting a boat seat, said outward extending portions of said four bent leg members received by said bottom opening to place said boat seat stand in a storage configuration, wherein, with said vertical portions of said four bent leg members received by said vertical base member bottom opening and with said bushing circular opening receiving a member therein, said member received therein does not engage said vertical portions of said four bent leg members.

* * * * *